United States Patent [19]

Rayer et al.

[11] 4,435,233

[45] Mar. 6, 1984

[54] PROCESS FOR THE PREPARATION OF A SMOKE COMPOSITION

[75] Inventors: Peter Rayer, Müllheim; Hartmut Krone, Auggen; Alois Schiessl, Marzoll; Wolfgang Steinicke, Bad Reichenhall; Wolfgang Trede, Weil am Rhein, all of Fed. Rep. of Germany

[73] Assignee: Buck Chemisch-Technische Werke GmbH & Co., Fed. Rep. of Germany

[21] Appl. No.: 343,839

[22] Filed: Jan. 29, 1982

[30] Foreign Application Priority Data

Feb. 9, 1981 [DE] Fed. Rep. of Germany ..... 3104464

[51] Int. Cl.[3] ..... C06B 33/02

[52] U.S. Cl. ..... 149/44; 149/37; 149/87; 149/2; 102/334; 264/3 C

[58] Field of Search ..... 149/87, 37, 44; 264/3 C; 102/334

[56] References Cited

U.S. PATENT DOCUMENTS

| | | | |
|---|---|---|---|
| 2,995,526 | 8/1961 | De Ment | 149/81 |
| 3,338,763 | 8/1967 | Kristal et al. | 264/3 C |
| 3,706,608 | 12/1972 | Geisler | 264/3 C |
| 3,729,351 | 4/1973 | Kruse | 264/3 C |
| 3,759,216 | 9/1973 | Sanders et al. | 102/334 |
| 4,186,664 | 2/1980 | Huber et al. | 102/334 |
| 4,238,254 | 12/1980 | Prahauser et al. | 149/87 |
| 4,324,183 | 4/1982 | Prahauser et al. | 102/334 |

FOREIGN PATENT DOCUMENTS

| | | | |
|---|---|---|---|
| 2555323 | of 0000 | Fed. Rep. of Germany . | |
| 2841815 | of 0000 | Fed. Rep. of Germany . | |
| 3048147 | of 0000 | Fed. Rep. of Germany . | |
| 2908116 | 9/1979 | Fed. Rep. of Germany | 102/334 |
| 3035799 | 1/1981 | Fed. Rep. of Germany | 102/334 |

*Primary Examiner*—Stephen J. Lechert, Jr.
*Assistant Examiner*—Joel P. Okamoto
*Attorney, Agent, or Firm*—Kenway & Jenney

[57] ABSTRACT

This invention comprises a process for the preparation of a smoke composition based on hexachloroethane, zinc oxide, and metal powder, in which zinc oxide granules obtained by high compression and subsequent crushing are used as a mixture component and the intermittent burnoff of previous smoke compositions of this type is thus avoided; the invention also concerns a smoke generator filled with such a smoke composition.

5 Claims, 1 Drawing Figure

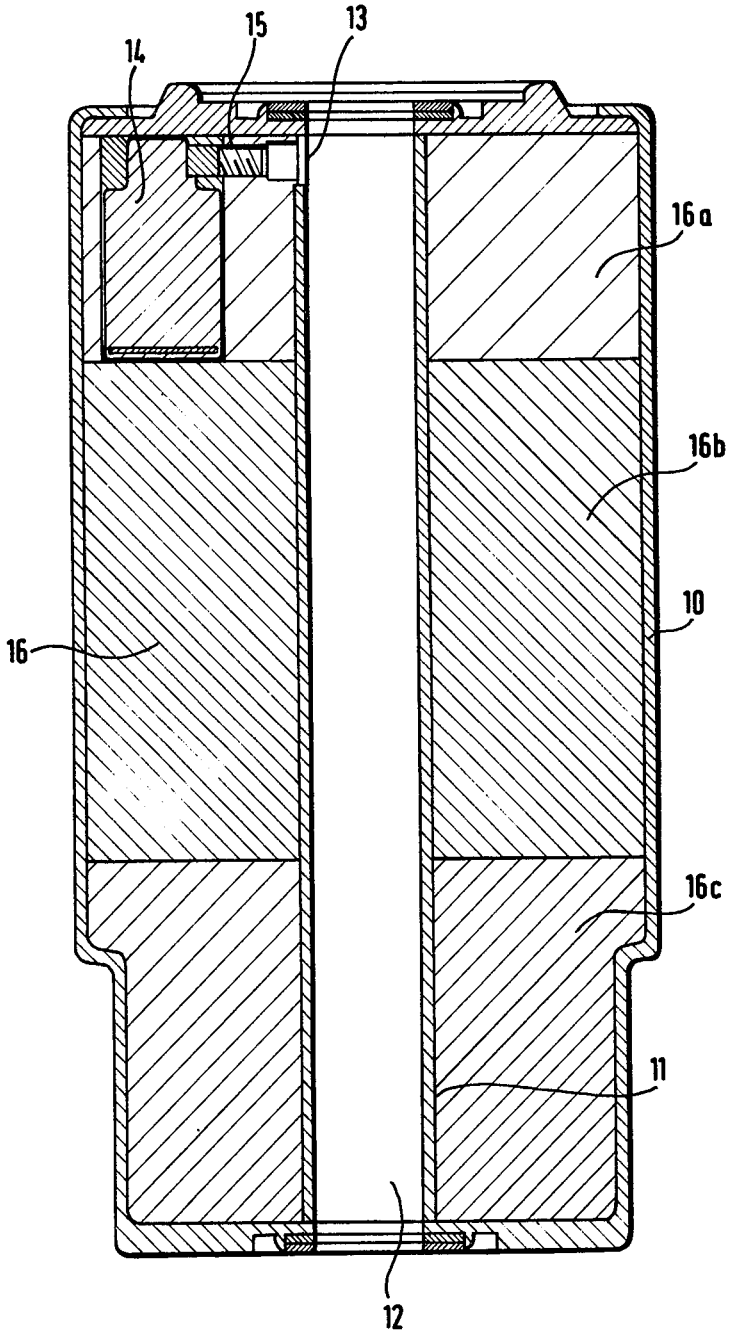
15
13
14
16a
16b
10
16
16c
11
12

PROCESS FOR THE PREPARATION OF A SMOKE COMPOSITION

This invention concerns a process for the preparation of a smoke composition, particularly for heavy-duty mortar shells, from a mixture of hexachloroethane, zinc oxide, and metal powder, with the mixture being compressed by high pressure into a self-supporting solid.

An important tactical aspect in the use of smoke munitions with mortars is the fact that the smoke screen is built up within a short time and is maintained at a constant level for a very specific time span. In other words, the visual screening or camouflage must exist over a precisely defined period of time, with precisely predictable beginning and end points. This requires a smoke composition with a smoke initiation as spontaneous as possible, with uniform smoke evolution during the entire burnoff without any break in the output of smoke, and with a definite, reproducible period of action. However, it is difficult to achieve this, particularly when the smoke composition is also to be used in extremely heavy-duty projectiles, i.e., in projectiles with very high muzzle velocities.

German Patent Application Disclosure 2,555,323 discloses a smoke substance with a highly compressed smoke composition based on hexachloroethane, zinc oxide, and metal powder, which can be fired with high muzzle velocities. In the associated supplementary Application German Patent Application Disclosure 2,841,815, it is stated that with this smoke composition a spontaneous smoke initiation can be achieved by using a fast-reacting primer charge, also called a smoke priming charge. The use of such a primer charge is not without problems, however, specifically because the course of reaction shows an interruption in the transition from the preliminary smoke to the main smoke. To prevent this interruption, it has been proposed in a second supplementary application (P 3,048,147.1) that the smoke primer and the main smoke be arranged in the form of gear teeth.

A spontaneous and thus an exactly defined smoke initiation is actually achieved with the smoke compositions mentioned, and an interruption between the preliminary smoke and the main smoke is also avoided, but practical tests have shown that the reaction time is still subject to considerable variations, and is therefore not exactly reproducible. At the same time, it was found that the smoke evolution proceeds more or less intermittently during the burnoff of the primer charge and also during the burnoff of the main smoke charge, which not only impairs the camouflage effect but must also necessarily cause variations of the reaction time.

It is therefore the purpose of this invention to provide a process for the preparation of a smoke composition of the type mentioned above which guarantees that the smoke composition shows a constant burnoff and thus a constant smoke evolution over the entire time of reaction and that the time of reaction is precisely predictable and reproducible.

The invention is based on knowledge obtained from extended tests of such smoke compositions and their burnoff. It was found here that the composition, even though it is highly compressed, is not solid and is not homogeneous from the viewpoint of the integrity of the individual particles. Instead, layers are formed during the compression of the compound which adhere more or less satisfactorily to one another. In the burnoff, the particles which are still not reacting or are just reacting are entrained by the smoke gases quite preferentially at these stratification planes or just above them, and the heat transmission to the layer of the compound lying below them is thus disturbed. The result of this is that the smoke reaction breaks down and only resumes gradually. The intermittent burnoff mentioned above occurs in this way, and in turn brings about an inexactly definable duration of the smoking time, because it can last for different times from smoke charge to smoke charge before the reaction fully resumes after such an interruption. Another proof of the layer formation described also results from the fact that the composition easily breaks off of the fully compressed smoke generator, preferentially in the shape of a cup. This breakup of the compressed charge obviously also represents a substantial drawback; since no cavities may exist in the interior of the smoke solid because of the high mechanical load during firing, this breakoff and this cup formation is equivalent to waste.

For this reason, the solution of the problem pursuant to the invention consists of avoiding this layer formation in the compressed smoke composition, which is accomplished by converting powdered zinc ozide into granulated zinc oxide by high compression and subsequent crushing, and then mixing the granulated zinc oxide with the other charge components. Instead of the previously used commercial zinc oxide powder, zinc oxide granules are therefore used, which can be produced from the zinc oxide powder by high compression followed by crushing.

It was specifically found that the commercial, extremely fine-grained zinc oxide used heretofore behaves like a lubricant or release agent. It encases the other components of the smoke composition, the hexachloroethane and the metal powder, and thus prevents them from packing together during the compression. By contrast, if zinc oxide granules are used, a framework of hexachloroethane is obtained in effect with embedded metal powder, and islands of zinc oxide granules embedded between them. The framework of hexachloroethane and metal powder itself is bonded very firmly and lends the entire composition a solid integrity and a homogeneous structure without layers.

No particles of the composition not yet entering into reaction are any longer torn out during the burnoff of the compositions thus prepared, or this effect is at least reduced to a substantial extent. However, this is equivalent to a substantial improvement of the uniformity of the burnoff; the well-known intermittency of smoke evolution therefore does not occur, and the total smoking time is exactly predictable and reproducible. Furthermore, an improvement of the yield of smoke is found, because a more complete reaction takes place as a result of the longer cohesion of the reaction components. The cup formation from the breakup of the charge no longer occurs, and the rejection rate in the manufacture of the smoke generators is therefore lowered to a substantial extent.

Because the rate of reaction of the composition is controlled by the fraction of metal powder, the use of zinc oxide granules ultimately also has an accelerating effect on the reaction; on the one hand, the hexachloroethane and metal powder no longer have the reaction-inhibiting zinc coating, but are in direct contact with one another, and on the other hand, the hexachloroethane-metal powder framework has a high concentration of metal powder because of the missing zinc oxide fraction. Conversely, to achieve the same reaction rate, the fraction of metal powder can be reduced by 1 to 2% in comparison with the previously known smoke compositions.

This improved cohesion of the smoke composition also leads to an improved transition of the burnoff from a fast-reacting smoke composition to a slower-reacting smoke composition, or for example, from a smoke primer charge to a main smoke charge. If the difference in the reaction rates between the two charges is not too large, the complicated construction of the gear teeth between the two charges can even be dispensed with. It is also possible to lengthen the smoking period by an extremely slow-reacting aftercharge. In this case, the entire charge then consists of partial charges compressed together in layers, specifically a primer charge, a main smoke charge, and an aftercharge. This simple layered construction, consisting of three different compositions with different reaction rates, is also very beneficial for other reasons. For one, only the preliminary smoke charge is brought into reaction with the ignition cartridge, i.e., a very large preliminary smoke reaction is set in motion, which leads to an extremely intense smoke initiation. For another reason, the smoking period can be adjusted anywhere within certain limits solely by varying the ratio of the quantities of main smoke and aftermsoke to one another. Since the reaction-accelerating effect of the metal powder depends on its grain size and the grain size distribution can be very different from batch to batch, it has been necessary in the past to compensate for the variations in the smoking time in the formulation. To be able to achieve this now, as described, simply by the distribution of amounts, represents a substantial simplification in manufacturing.

The zinc oxide granules are produced by high compression of powdered zinc oxide using roller mills and then crushing the compressed bed. The pressure during the composition is chosen to be high enough that the granules retain their shape and size during the production of the composition. On the other hand, however, the pressure should not be too high, because the granules should have an active surface area large enough that their reactivity does not differ substantially from that of powdered zinc oxide. The grain size of the granules is approximately set at approximately 1 mm.

One form of embodiment of the smoke generator pursuant to the invention is shown in the drawing, and the single FIGURE specifically shows the smoke generator in longitudinal section.

The smoke generator according to the drawing has a cylindrical smoke generator housing 10 through the center of which passes an inner tube 11. The interior of the inner tube 11, or the degassing channel, is designated as 12. An opening 13 in the inner tube 11 opens into the degassing channel 12. The single ignition cartridge visible in the drawing—in all, there are generally three present in symmetrical arrangement—has the reference symbol 14. A delay tube 15 connects the ignition cartridge 14 to the opening 13.

The smoke composition designated as a whole as 16 consists of a primer charge **16*a*, a main smoke charge 16*b*, and an aftercharge 16*c*. The ignition cartridge 14 is embedded in the easily ignitable primer charge 16*a*** which provides for a rapid initiation of the smoking action. The relative amounts and the formulations of the individual charges are chosen so that a spontaneous ignition of smoking, an essentially constant generation of smoke during the entire reaction time, and exact adherence to the desired period of smoking are guaranteed. The main smoke/aftersmoke ratio is the factor to be determined and the ignition cartridge/timer unit assures the rapid initiation of smoking.

We claim:

1. Process for the preparation of a smoke composition, particularly for extremely heavy-duty projectiles, preferably mortar shells, from a mixture that includes hexachloroethane and metal powder, with the mixture being compressed by high pressure into a self-supporting solid, wherein the improvement comprises the steps of providing powdered zinc oxide, highly compressing said powdered zinc oxide, crushing said high compressed zinc oxide powder to form a granular zinc oxide, and mixing said granulated zinc oxide with said hexachloroethane and said metal powder to form said mixture.

2. Process purusant to claim 1, wherein said highly compressing is at a level that the zinc oxide granules retain their shape in any subsequent cooling and during said compression of said mixture, but the reactivity of the powdered zinc oxide is retained.

3. Process pursuant to claim 1 or 2, wherein said compression and crushing steps produce zinc oxide granules with a grain size of approximately 1 mm.

4. Smoke generator consisting of a closed metal housing, a smoke composition prepared in accordance with claim 1, said metal housing consisting of two coaxial tubes which form an annular annular chamber between themselves that receive said smoke composition, and an ignition charge consisting of at least one ignition cartridge being embedded in the smoke composition, wherein the improvement comprises said smoke composition comprising an easily ignitable primer charge enclosing the ignition cartridge, a main smoke charge which is difficult to ignite next to it, and an aftercharge following the main smoke charge, said primer, main and after charges having different ratios of the constituent materials of said smoke composition to thereby provide the varying operating characteristics.

5. Smoke generator pursuant to claim 4, characterized by the fact that the time of smoking is determined by the relative amounts of main smoke and after charge.

* * * * *